US010065773B2

(12) United States Patent
Seidler et al.

(10) Patent No.: US 10,065,773 B2
(45) Date of Patent: Sep. 4, 2018

(54) CONTAINER LID AND VALVE INCLUDING A LOCKING MECHANISM

(71) Applicant: LIQUISTOP LLC, Stony Brook, NY (US)

(72) Inventors: Jack Seidler, New York, NY (US); Antonio F. Coloneri, Stony Brook, NY (US)

(73) Assignee: LIQUISTOP LLC, Stony Brook, NY (US)

( * ) Notice: Subject to any disclaimer, the term of this patent is extended or adjusted under 35 U.S.C. 154(b) by 0 days.

(21) Appl. No.: 15/626,670

(22) Filed: Jun. 19, 2017

(65) Prior Publication Data

US 2017/0369214 A1 Dec. 28, 2017

Related U.S. Application Data

(60) Provisional application No. 62/353,219, filed on Jun. 22, 2016.

(51) Int. Cl.

| | |
|---|---|
| ***B65D 47/00*** | (2006.01) |
| ***B65D 47/08*** | (2006.01) |
| ***A47G 19/22*** | (2006.01) |
| ***B65D 43/02*** | (2006.01) |
| ***B65D 47/20*** | (2006.01) |

(52) U.S. Cl.

CPC ..... *B65D 47/0823* (2013.01); *A47G 19/2272* (2013.01); *B65D 43/0202* (2013.01); *B65D 47/2018* (2013.01); *B65D 2543/00046* (2013.01)

(58) Field of Classification Search

CPC ..... B65D 47/0823; B65D 43/0202; B65D 2543/00046; A47G 19/2272

USPC ..... 220/713

See application file for complete search history.

(56) References Cited

U.S. PATENT DOCUMENTS

| | | | | |
|---|---|---|---|---|
| 241,852 | A | 5/1881 | Everest | |
| 245,041 | A | 8/1881 | Wood | |
| 385,328 | A | 6/1888 | Straffin et al. | |
| 422,935 | A | 3/1890 | Hamsley | |
| 1,525,032 | A | 2/1925 | Grady | |
| 3,208,629 | A | 9/1965 | Beeson | |
| 3,635,380 | A | 1/1972 | Fitzgerald | |
| 3,727,808 | A | 4/1973 | Fitzgerald | |
| 3,730,399 | A | 5/1973 | Dibrell et al. | |
| 3,739,938 | A | 6/1973 | Paz | |
| 3,972,443 | A | 8/1976 | Albert | |
| 4,099,642 | A | 7/1978 | Nergard | |
| 4,127,212 | A * | 11/1978 | Waterbury | B65D 17/506 220/255.1 |

(Continued)

*Primary Examiner* — Ernesto Grano

(74) *Attorney, Agent, or Firm* — Preti Falherty Beliveau & Pachios, LLP

(57) ABSTRACT

A container lid for a fluid container is formed of a flexible resilient material includes a body member having a drinking aperture and a valve. Upon application of a first force to an actuator region of the body member, the valve unseals the drinking aperture and upon removal of the first amount of pressure, the valve reseals the aperture. Upon the application of a second force to the actuator region that is greater than the first force, the valve engages a locking mechanism and the aperture remains unsealed upon removal of the applied second force. In a second embodiment first and second actuator regions are employed and the application of a force to the second actuator region secures the valve in an unsealed orientation.

24 Claims, 11 Drawing Sheets

(56) References Cited

U.S. PATENT DOCUMENTS 4,133,446 A 1/1979 Albert
4,136,799 A 1/1979 Albert
4,138,033 A 2/1979 Payne et al.
4,170,724 A * 10/1979 Waterbury ..... B65D 17/506 206/807
4,184,603 A 1/1980 Hamilton, Sr.
4,190,174 A 2/1980 Haimowitz
5,086,941 A * 2/1992 English ..... B65D 55/024 220/345.2
5,485,938 A 1/1996 Boersma
5,702,025 A 12/1997 Di Gregorio
5,706,972 A 1/1998 Sousa
6,062,419 A 5/2000 Kruger et al.
6,336,574 B1 1/2002 Hins
6,386,404 B1 5/2002 Auer
D477,223 S * 7/2003 Smith ..... D9/447
6,824,003 B1 * 11/2004 Wong ..... B65D 43/0202 220/254.9
7,275,653 B2 * 10/2007 Tedford, Jr. ..... B65D 47/286 220/254.9
7,954,659 B2 6/2011 Zuares et al.
7,959,029 B2 6/2011 Whitaker et al.
8,272,525 B1 9/2012 La Torre et al.
8,297,462 B1 10/2012 Joyce
8,919,593 B2 * 12/2014 Sinacori ..... B65D 47/286 220/254.9
2002/0148845 A1 10/2002 Zettle et al.
2003/0094467 A1 5/2003 Dark
2005/0051552 A1 3/2005 Kim
2006/0081633 A1 * 4/2006 Schmidtner ..... B65D 43/0208 220/254.9
2006/0261068 A1 * 11/2006 Schmidtner ..... B65D 43/0208 220/254.9
2006/0283859 A1 * 12/2006 Lu ..... A47G 19/2272 220/253
2007/0278228 A1 * 12/2007 Wong ..... B65D 47/286 220/254.9
2008/0190946 A1 * 8/2008 Wong ..... B65D 47/286 220/711
2008/0272134 A1 * 11/2008 Rohe ..... A45F 3/16 220/713
2010/0059535 A1 3/2010 Syrkos
2010/0102060 A1 4/2010 Ruse, Jr.
2011/0068113 A1 * 3/2011 Kim ..... B65D 43/0212 220/713
2012/0037651 A1 2/2012 Steuer
2012/0067890 A1 * 3/2012 Cahen ..... A45F 3/18 220/254.3
2012/0097690 A1 * 4/2012 Chien ..... B65D 43/0212 220/713
2014/0048549 A1 * 2/2014 Wille ..... B65D 43/0222 220/713
2015/0250340 A1 * 9/2015 Liu ..... B65D 43/02 220/254.9
2017/0071379 A1 * 3/2017 Savenok ..... A47G 19/2272
2017/0099969 A1 * 4/2017 Coon ..... A47G 19/2272
2017/0224139 A1 * 8/2017 Santos, III ..... A47G 19/2211

* cited by examiner

CONTAINER LID AND VALVE INCLUDING A LOCKING MECHANISM

STATEMENT REGARDING FEDERALLY SPONSORED RESEARCH OR DEVELOPMENT

Not Applicable

BACKGROUND OF THE INVENTION

The present disclosure relates to a lid configured for coupling to an open top fluid container and, more specifically, to a container lid having a valve configured to seal and unseal a drinking aperture formed in the container lid wherein the valve is also permanently secured in a position in which the drinking aperture remains unsealed.

Plastic disposable lids for mounting to open top fluid containers, such as coffee cups, are well-known in the art. Such lids are intended to avoid undesired spillage of a liquid due to accidental tipping of the cup or jostling during transit. While spillage of a beverage from a fluid container is almost always undesirable, when the beverage is a hot beverage such as coffee or tea, spillage also poses a safety hazard and can result in serious burns.

A number of different types of container lids are known in the art that include a rim that is cooperative with and may be urged over a lip of an open top fluid container to secure the lid to the fluid container.

One prior art container lid illustrated in FIGS. 1*a* and 1*b* depicts a lid 100 with a drinking aperture closed and opened respectively. The lid is formed of a thin plastic material and includes a tab defined by thin tearable borders that allow the tab to be bent back over the lid and secured to the top of the lid to create a drinking opening. After bending the tab back over the top of the lid it is no longer possible to seal the drinking opening.

Another prior art container lid 200 is shown in FIGS. 2*a* and 2*b*. This lid, like the prior lid, includes a tab that may be bent back over the top of the lid and secured to provide a drinking opening. After bending the tab back over the top of the lid, as in the case of the prior lid, it is no longer possible to seal the drinking opening.

Yet another prior art container lid 300 is shown in FIGS. 3*a* and 3*b*. This lid includes a drinking opening which remains open at all times. Consequently, spillage of a beverage is always a risk if the container is tipped or jostled.

Container lids that address the deficiencies of the above-referenced lids are the subject of U.S. Pat. No. 9,296,532 and U.S. Pat. No. 9,475,626 which are assigned to the present assignee. The above-identified patents disclose a container lid that is mountable to the lip of an open top fluid container, such as a coffee cup, by urging a rim of the lid over the lip of the container. The lid includes a body member and a valve that permits a drinking aperture to be temporarily unsealed by applying downward pressure to a portion of the top surface of the lid. The valve seals the drinking aperture when the downward pressure is removed.

While it is desirable for a drinking aperture to be unsealed temporarily while drinking from the fluid container to avoid inadvertent spillage, it would be desirable for a user to be able to permanently lock the valve so the drinking aperture remained unsealed in certain circumstances.

SUMMARY OF THE INVENTION

In accordance with the present invention an improved lid for a fluid container is disclosed. In a first embodiment a single actuator, such as a button, is provided that allows a user to temporarily unseal a drinking aperture while drinking from the fluid container. Additionally, the same actuator may be used to engage a locking mechanism so that the drinking aperture remains unsealed. In a second embodiment a first actuator, such as a button formed in the lid, is provided that actuates a valve to allow a user to temporarily unseal a drinking aperture while the user is drinking from the fluid container and a second actuator formed in the lid permits the user to actuate a locking mechanism to permanently open the valve so that the drinking aperture remains unsealed.

In the first embodiment, the lid includes a body member having a peripheral lip configured to permit the lip to be urged over the rim of a cooperative fluid container to secure the lid to the container. The body member includes a drinking aperture formed along the periphery of the body member and an actuator, such as a button protruding from the top surface of the body member. The lid also includes a valve having a first portion and a second portion that is used to seal and unseal the drinking aperture. The first portion of the valve has a first end and a second end and is secured directly to the bottom surface of the body member. The second portion of the valve includes a first end and a second or distal end. The first end of the second portion is coupled to and extends from the second end of the first portion and terminates at the distal end of the second portion. The second portion includes a contact region along at least a portion of the second portion between the first and second ends of the second portion and a sealing member adjacent the second end of the second portion. The contact region confronts or abuts the bottom surface of the body member in the absence of downward pressure applied to the actuator. In response to manually applied pressure to the actuator, the bottom surface of the body member abuts the contact region of the second portion of the valve resulting in deflection of the second portion of the valve.

The valve is configured as a spring like member that normally urges the sealing member toward the aperture such that the sealing member occludes the aperture to prevent spillage of a liquid from the fluid container in the absence of manual pressure applied to the actuator. Upon the application of manual pressure to the actuator, the body member deforms and the bottom surface of the body member abuts the contact region of the second portion and urges the second end of the second portion of the valve and the sealing member adjacent the second or distal end of the second portion away from the aperture so as to unseal the aperture.

In addition, the lid includes a locking mechanism that permits the sealing member of the valve to be locked in a position with the sealing member spaced from the aperture so as to unseal the aperture. More specifically, the lid includes one or more posts that extend from the bottom surface of the body member. In one embodiment, opposing posts extend from the bottom surface of the body member on opposite sides of the second portion of the valve. Each post includes an inner wall adjacent an edge of the second portion of the valve. Inner opposing walls are angled inward near the ends of the inner walls such that the spacing between the inner walls is greater adjacent the bottom surface of the body member than near the ends of the inner walls most distal from the bottom surface of the body member. The aperture may be temporarily unsealed via the application of a first amount of manual pressure to the button so as to cause deflection of the second portion of the valve and spacing of the sealing member from the aperture as described above. The valve is formed of a resilient material and is lightly sprung toward the drinking aperture so as to seal the aperture in the absence of pressure applied to the button. When manual pressure is removed from the button, the sealing member reseals the aperture if the valve is not locked in the unsealed orientation as subsequently described.

The width of the second portion of the valve in the region between the inner post walls is less than the spacing between the inner walls adjacent the bottom surface of the body member but greater than the distance between the ends of the inner walls near the ends of the posts most distal from the bottom surface of the body member. Thus, upon the application of a sufficient second amount of pressure manually applied to the button, which pressure is greater than the first amount of pressure, the second portion of the valve member deforms and is urged beyond the distal ends of the inner post walls. Once the second portion of the valve member is urged beyond the distal ends of the inner post walls, the distal ends of the inner post walls prevent the second portion from returning to the sealing orientation in which the sealing member occludes the aperture since with width of the second portion of the valve is greater than the spacing between the distal ends of the inner walls of the post members parallel to the transverse axis through the posts. It should also be appreciated that the narrowed spacing between the posts or a notch that secures the second portion need not be at the distal ends of the posts. Instead, the narrowed spacing or notch may be provided at a predefined location along the length of the inner walls.

In a second embodiment the lid includes a body member and a valve having a first portion securely affixed to the bottom surface of the body member and a second portion that extends from the first portion as described above. In the second embodiment, the application of manual pressure applied to a first actuator, such as a button extending outward from the top surface of the body member, causes the bottom surface of the body member to abut a first contact region on the second portion of valve to provide downward deflection of the second portion of the valve to unseal the drinking aperture while the first button is being depressed. Upon removal of applied pressure to the first actuator, the second portion of the valve returns to a sealing orientation in which the sealing member generally occludes and thereby seals the drinking aperture.

A second actuator, such as button, is provided that extends outward from the top surface of the body member. The second actuator is used to secure or lock the sealing member in a position spaced from the drinking aperture and thereby permanently unseal the drinking aperture. In one embodiment, the second actuator is positioned between the first actuator and the drinking aperture. Spaced posts extend outward from the bottom surface of the body member as described above. The posts have opposed inner walls that are located on either side of the second portion of the valve member. The inner post walls are angled inward such that the walls are spaced from one another by a width slightly greater than the width of the second portion of the valve adjacent the bottom surface of the body member and are spaced from one another by a distance narrower than the width of the second portion of adjacent the ends of the posts most distal from the bottom surface of the body member.

Upon application of sufficient manual pressure to the second actuator, the body member deforms and the bottom surface of the body member abuts a second contact region on the second portion of the valve and causes the second portion of the valve to deform and deflect beyond the region of the inner walls having the narrowed spacing. Since the width of the second portion is greater than the distance between the opposed inner walls in the region where the inner wall spacing is narrowed, the second portion of the valve cannot return to its original position in which the sealing member occludes the drinking aperture and the aperture remains permanently unsealed.

BRIEF DESCRIPTION OF THE DRAWINGS

The invention will be more fully understood by reference to the Detailed Description of the Invention in conjunction with the drawings of which.

DETAILED DESCRIPTION OF THE INVENTION

Figure 1A:
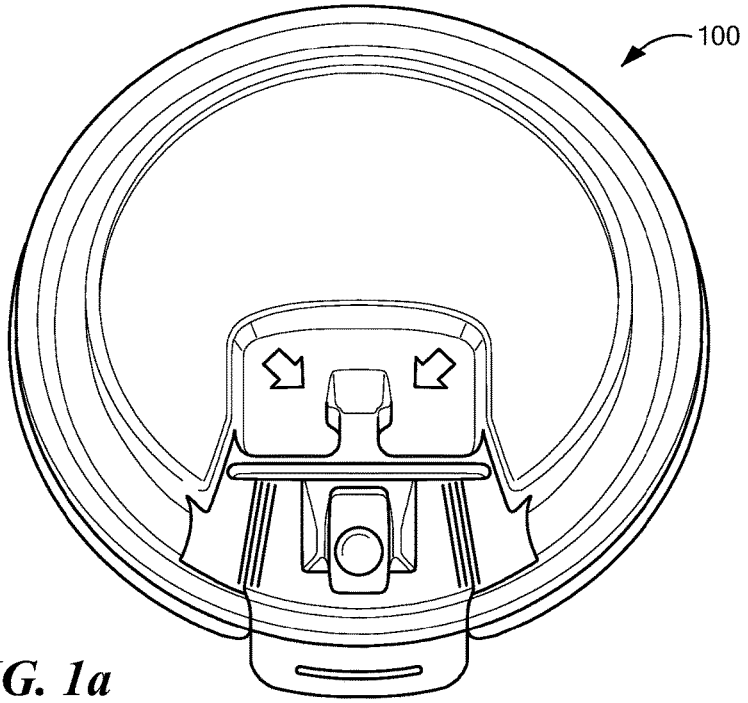
FIG. 1*a* illustrates a first prior art container lid having a tab sealing formed as a continuous integral part of the container lid and FIG. 1*b* illustrates the container lid of FIG. 1*a* with the tab folded back over the top surface of the lid and secured via an engagement mechanism on the top surface to provide a drinking opening.
Figure 1B:
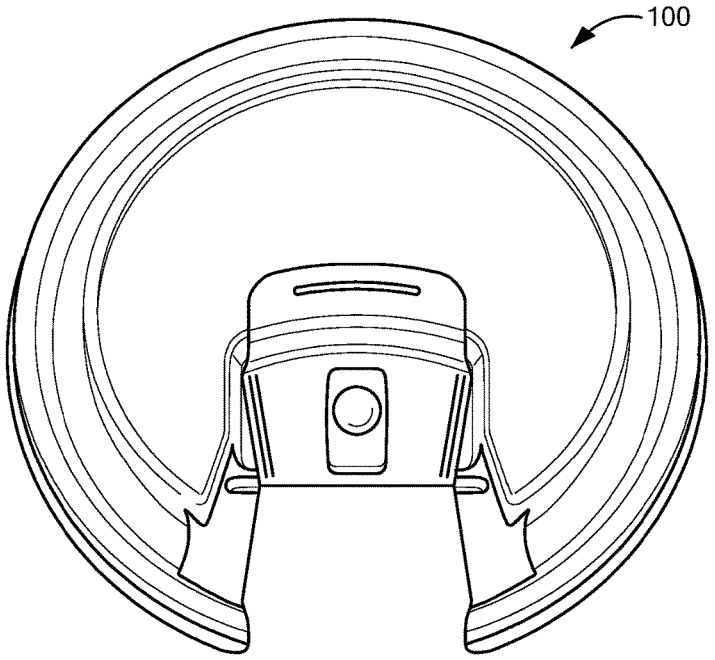
Figure 2A:
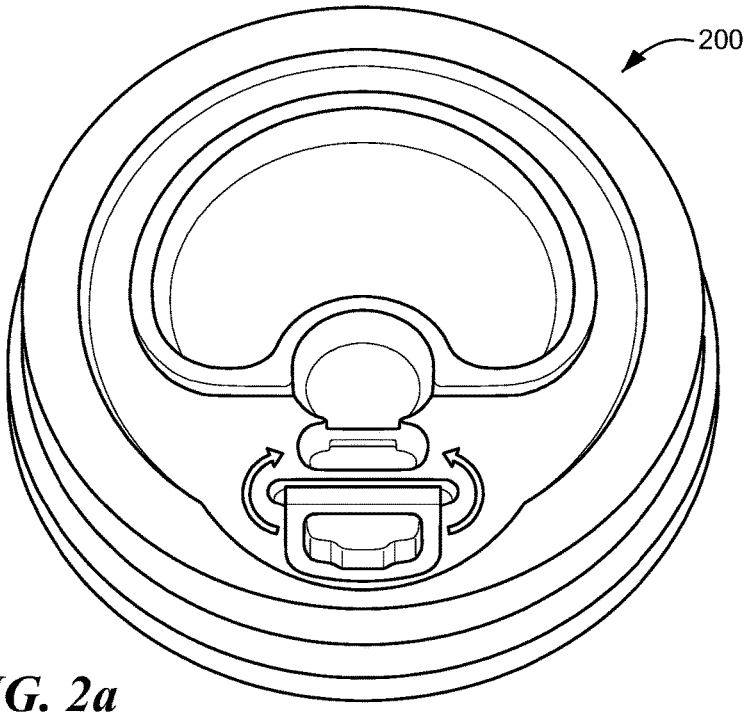
FIG. 2*a* illustrates a second prior art container lid having a tab generally occluding a drinking aperture and FIG. 2*b* is a picture of the prior art container of FIG. 2*a* with the tab folded back over the top surface of the lid and secured via an engagement on the top surface to provide a drinking opening.
Figure 2B:
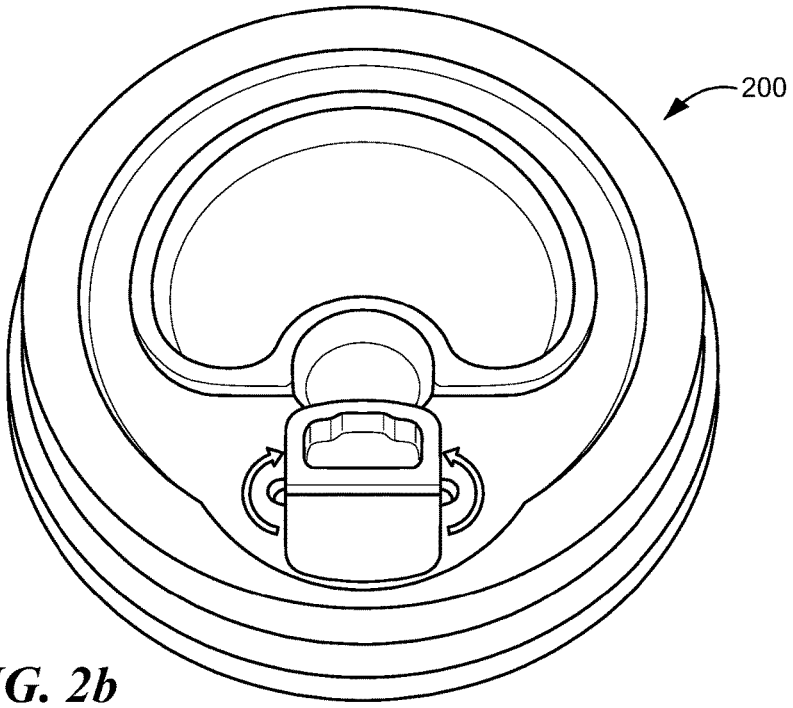
Figure 3A:
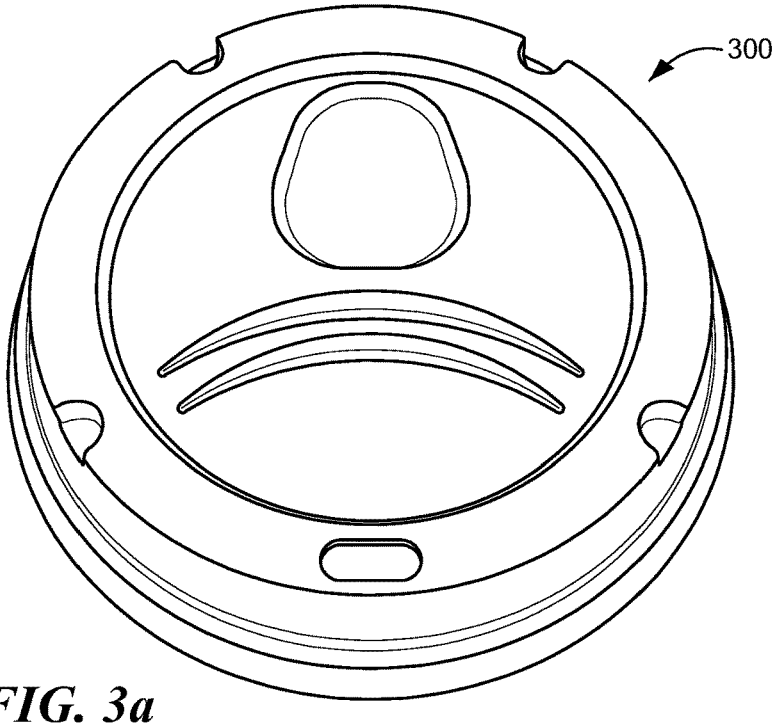
FIGS. 3*a* and 3*b* illustrate the top and bottom of a third prior art container lid having a drinking aperture formed in the lid.
Figure 3B:
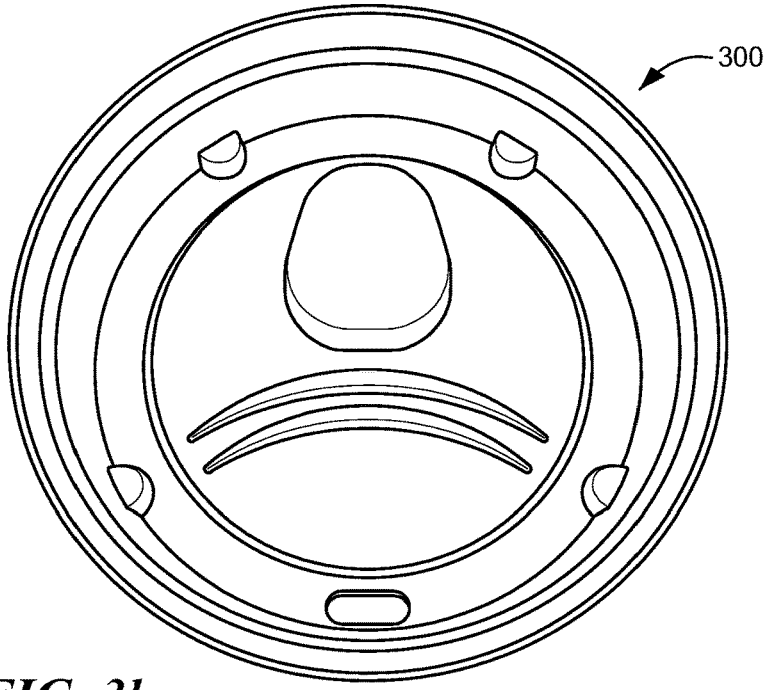

The disclosure of U.S. Provisional patent application No. 62/353,219, filed Jun. 22, 2016, is hereby incorporated by reference herein in its entirety.

In accordance with the present invention, an improved container lid for a fluid container or cup is disclosed. The container lid includes a valve that permits a user to temporarily unseal a drinking aperture while drinking from the fluid container and, additionally, permits the user to secure or lock the valve in a configuration that maintains the drinking aperture unsealed. A first embodiment of the disclosed lid employs a single actuator, such as a button formed in the container lid, to achieve the desired operation. A second embodiment employs a first actuator formed in the container lid that is cooperative with a valve to temporarily unseal the drinking aperture and a second actuator, such as a button, that is cooperative with the valve to secure or lock the valve in an orientation that maintains the drinking aperture unsealed.

The first embodiment of a container lid in accordance with the present invention is illustrated in FIGS. 4-7. Lid 400 includes a body member 410 and a valve 420.

Body member 410 includes a central portion 412 that extends to an outer periphery 414 having a rim configured to couple to a lid of a fluid container upon urging of the rim over the lip. Body member 410 defines an aperture 416 therethrough and has a top surface 410*a* and a bottom surface 410*b*. Central portion 412 includes an actuator, illustrated as a button or protrusion 418 that extends from the top surface 410*a* of the body member 410. Actuator 418 is located generally centrally in the central portion 412 of the body member 410. The central portion 412 of the body member 410 is configured to be downwardly deformable and deflectable upon the application of manually applied pressure to the actuator 418.

By way of example and not limitation, the body member 410 and the valve 420 may each be formed of any thin, flexible and resilient material, such as a plastic (e.g. polystyrene), cellulose, a bio-degradable material, such as a soy based material, or from any suitable low cost material suitable for single use applications such as disposable coffee cup lids. Alternatively, the body member 410 and/or the valve 420 may be fabricated from a metal, such as a thin, resilient and deformable stainless steel material or any other suitable metal.

While the illustrated embodiment employs a button as the actuator 418, the actuator or actuator region may comprise a button, a flat portion of the central portion 412 of the body member or, alternatively, a depression or recess in the top surface (an inverted button) in the form of a protuberance extending outward from the bottom surface 410*b* of the central portion 412. Annular rings or thinner material may be provided around the actuator or actuator region to permit greater deflection of the actuator in response to an applied downward force.

The valve 420 includes a first portion 422 that is directly and permanently secured to bottom surface 410*b* of body member 410 and a second portion 424 that extends from first portion 422 and is movable relative to first portion 422 and the body member 410. The first portion 422 may include a rib 422*a* that serves to stiffen the first portion in the longitudinal direction.

The first portion 422 may be permanently secured to the bottom surface 410*b* of body member 410 via ultrasonic welding, staking, or via any other suitable technique known in the art. First and second portions 422, 424 of the valve 420 are coupled to one another by a hinge portion 423 in the form of a self-hinge. Hinge portion 423 may include at least one bend 423*a* to enable the second portion 424 to move between a free-state in which a sealing member 427 of the second portion 424 occludes the drinking aperture 416 and a depressed-state in which the second portion 424 moves away from the bottom surface 410*b* of the central portion 412 such that the sealing member 427 does not occlude the drinking aperture 416 as discussed in greater detail below.

The second portion 424 of valve 420 includes a riser 425 that supports the sealing member 427. In the depressed-state, the sealing member 427 is configured so as not to occlude the drinking aperture 416 of body member 410. The riser 425 can have any suitable shape and/or dimension. The sealing member 427 may include a protuberance 424*a* that includes a tapered surface 424*b* as illustrated, or alternatively, may comprise a flat member that abuts the bottom surface of the body member 410 surrounding the drinking aperture 416 so as to seal, generally seal or occlude the aperture 416 to impede fluid flow therethrough. The protuberance 424*a* extends through the aperture 416, at least while in the free-state, to generally seal or occlude the aperture 416. Upon the application of a first amount of manual pressure, the bottom surface of the central portion 412 abuts a contact region of the second portion 424 of the valve 420, which may correspond to a confronting surface of rib 428, to deflect the second portion 424 and thereby cause the sealing member 427 to unseal the aperture 416.

The rib 428 is positioned along at least a portion of the second portion of the valve 420 to increase stiffness of the second portion 424 in the longitudinal direction. Valve 420 may include any number of ribs 428 along any portion thereof (or none at all). For example, valve 420 may include at least two ribs disposed in parallel relation to one another. Two or more ribs may be longitudinally aligned and/or longitudinally offset from one another.

In operation, deflection of the central portion 412 in response to manually applied pressure to the button 418, causes the bottom surface 410*b* of the central portion 412 to abut a contact region of the second portion 424 and deflect the second portion 424 so as to generally pivot the second portion 424 relative to first portion 422 between the free-state and the depressed-state. The top surface of the rib 428 may serve as the contact region. Alternatively, the second portion 424 may include a contact region distinct from the rib 428 that confronts the bottom surface 410*b* in the vicinity of the button 418 so that the second portion 424 is deflected from the free-state to the depressed-state in response to the application of pressure to the button 418. The bottom surface 410*b* of the central portion 412 may contact or be spaced from contact region, which in the illustrated embodiment is a top surface 424*c* of the rib 428 while second portion 424 is in the free-state. The bottom surface 410*b* of the central portion 412 engages the top surface 424*c* of the second portion 424 or a suitable contact region formed in the second portion 424 while second portion 424 is deflected in the depressed-state.

Either the body member 410 or the valve 420, or both the body member 410 and the valve 420, are formed as a continuous single piece integral unit, such as by vacuum forming or molding. Additionally, in one embodiment discussed below in greater detail with respect to FIGS. 9*a*-9*c*, the body member 410 and the valve 420 and an interconnection portion coupling the body member 410 and the valve 420 are formed as a unitary continuous single piece integral unit. In this embodiment, the interconnection portion is folded and formed such that the valve 420 is disposed below the body member 410, is adjacent to and confronts the bottom surface 410*b* of the body member 410. The first portion of the valve 420, in one embodiment, is secured directly to the bottom surface 410*b* of the central portion 412 of the body member 410 as described above.

In addition to the above-described mechanism which permits a user to temporarily unseal the drinking aperture 416 for drinking from a fluid container to which the lid 400 has been mounted, the presently disclosed lid 400 includes a mechanism for securing or locking the valve 420 so as to maintain the aperture 416 in the unsealed state following the removal of manual pressure from the actuator 418.

Figure 7A:
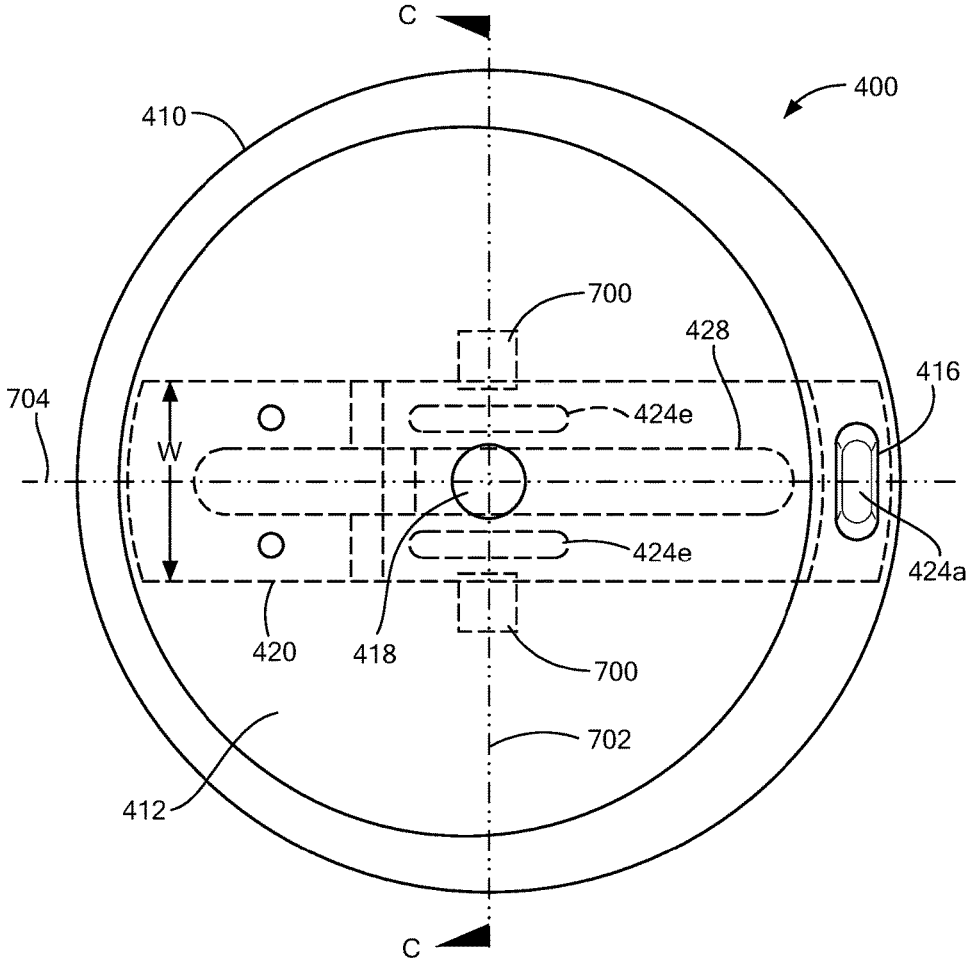
FIG. 7*a* is a top view of the container lid of FIG. 4.
Figure 7B:
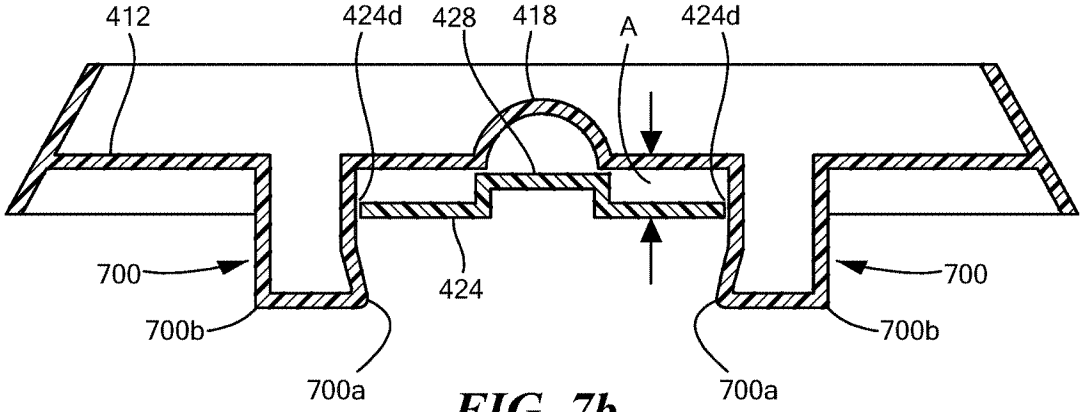
FIG. 7*b* is a cross-sectional view of the container lid of FIG. 7*a* along section CC illustrating the valve in position to seal the drinking aperture.
Figure 7C:
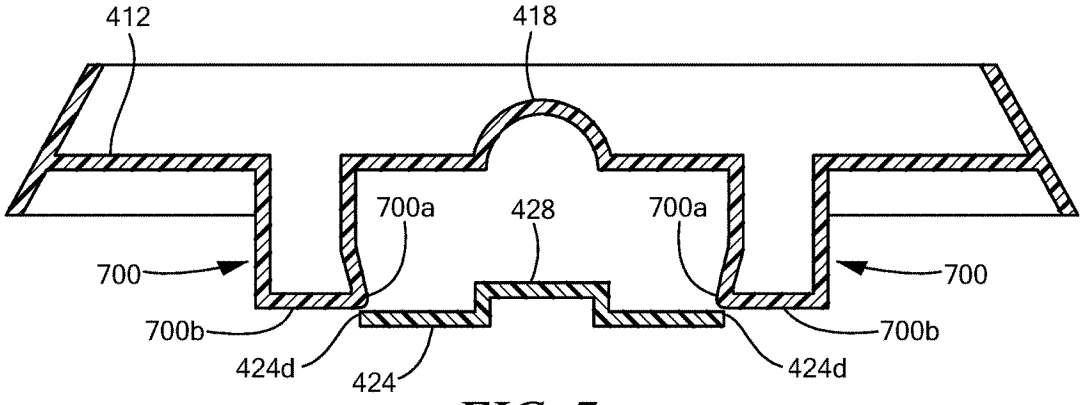
FIG. 7*c* is a cross-sectional view of the container lid of FIG. 7*a* along section CC after the second portion of valve has been urged beyond the distal ends of locking posts so as to permanently secure the valve in a non-sealing configuration.

Referring to FIGS. 7*a*-7*c*, the body member 410 includes posts 700 that extend outward from the bottom surface 410*b* of the central portion 412. The posts 700 are located on opposing sides of the second portion 424 and have opposed inner walls 700*a* adjacent respective edges 424*d* of the second portion 424 of the valve 420. The posts 700 and the actuator 418 are disposed generally along a transverse axis 702 that is generally perpendicular to a longitudinal axis 704 through the second portion 424 of the valve 420. The second portion 424 of the valve 420 has a width w generally along the transverse axis that is less than the spacing between the inner walls 700*a* of the posts 700 adjacent the bottom surface 410*b* of the central portion 412 to permit the second portion 424 to move freely between the posts 700, at least for a specified distance below the bottom surface 410*b* of the central portion 412 of the body member 410. Consequently, by applying a first amount of manual pressure to the actuator 418, the bottom surface 410*b* of the central portion 412 abuts the contact region of the second portion 424 and urges sealing member 427 of the second portion 424 away from the drinking aperture 416 so as to unseal the aperture 416. The second portion 424 is configured in a spring-like manner to lightly urge the sealing member toward the aperture 416 to generally seal the aperture 416 in the absence of a downward force applied to the actuator 418 from the top surface of the central portion 412. The aperture 416 may be sealed with the protuberance 424*a* extending through the aperture 416 with sidewalls 424*b* of the protuberance abutting edges of the aperture 416 or alternatively, via a generally flat sealing member 427 that confronts the underside of the aperture 416 and surrounding region so as to generally occlude the aperture 416. Alternatively, the aperture 416 may include a convex downward extending periphery that is cooperative with a concave sealing member (not shown) to seal the aperture 416.

The spacing between the inner walls 700*a* of the posts 700 adjacent the ends 700*b* of the posts 700 most distal from the bottom surface 410*b* of the central portion 412 or alternatively, at a location along the inner wall surfaces spaced from the bottom surface, is narrowed such that the opposed inner walls are spaced apart by a distance d less than the width w of the second portion 424 generally along the transverse axis 702. This may be achieved by angling the inner walls 700*s* inward toward each other along at least a portion of the length of the inner walls 700*a*. Thus, upon the manual application of a second force to the actuator 418 that is greater than the first force and of a sufficient magnitude, the second portion 424 is deflected downward and also deforms in the transverse direction so that edges 424*d* of the second portion 424 of the valve 420 are urged beyond the portions of the opposed inner walls having the narrowed spacing therebetween. Since the width w of the second portion 424 generally along the transverse axis 702 is greater than the spacing between the portions of the opposed inner walls having the narrowed spacing therebetween, the second portion 424 cannot assume its normal undeflected position in which the sealing member 427 seals the aperture 416 and the aperture 416 remains permanently unsealed. Following the application of the second force, the second portion 424 remains deflected with the sealing member 427 spaced from the aperture 416 in an unsealed orientation as illustrated in FIG. 7*c*, even upon the removal of the applied force to the actuator 418.

Thus, the above-described container lid permits the drinking aperture to be temporarily unsealed and additionally, allows the drinking aperture to be permanently unsealed, should a user of the lid so desire. More specifically, when the button 418 is depressed slightly, the valve will cause the sealing member 427 to unseal the aperture 416 and removal of pressure from the button 418 will result in the sealing member 427 resealing the aperture. If the button 418 is depressed further, the edges of the second portion 424 engage the inner walls 700*a* of posts 700 and present resistance to further downward deflection of the second portion 424 of the valve 420. If an even greater pressure of sufficient magnitude is applied to the button 418, the second portion 424 deforms in the transverse direction and flexes to permit the second portion 424 to move past the inwardly angled portion inwardly facing walls 700*a* of the posts 700. Once the second portion 424 of the valve 420 is urged beyond the angled portion at the distal ends 700*b* of the posts 700, the second portion 424 is locked below the posts 700 and the aperture 416 remains permanently unsealed. Optional slots 424*e* may be provided in the second portion 424 of the valve 420 to increase the flexibility of the second portion 424 in the transverse direction and facilitate the movement needed to urge the second portion 424 beyond the inwardly angled walls 700*a* of the posts 700. While the present embodiment secures or locks the valve 420 in the unsealed orientation once the second portion 424 is urged beyond the ends 700*b* of the posts, in another embodiment, the posts may be formed with notches formed in the inner walls 700*a* which engage the edges of the second portion 424 to provide the locking function, in which case, the locking function would not involve urging of the second portion 424 beyond the ends of the posts 700. Additionally, the inwardly facing walls may provide a narrowed spacing at a specified location between the bottom surface of the body member and the distal ends of the posts.

While the illustrated embodiment includes opposing posts, it will be appreciated by those of ordinary skill, that the presently described locking function may be implemented with a single post having a portion of a wall surface that is angled toward the second portion of the valve 420, an inwardly extending ledge, or a notch that is cooperative with the second portion 424 to secure the second portion 424 in the unsealed orientation in response to sufficient deflection of the second portion 424. Alternatively, one or more posts may be cooperative with a tab or flange extending from the second portion 424 to provide the locking function.

The above-described container lid may be fabricated via vacuum-forming techniques or molding processes when working with plastic or other materials suitable for fabrication using such processes to permit low cost, high volume production of single use lids.

Figure 8A:
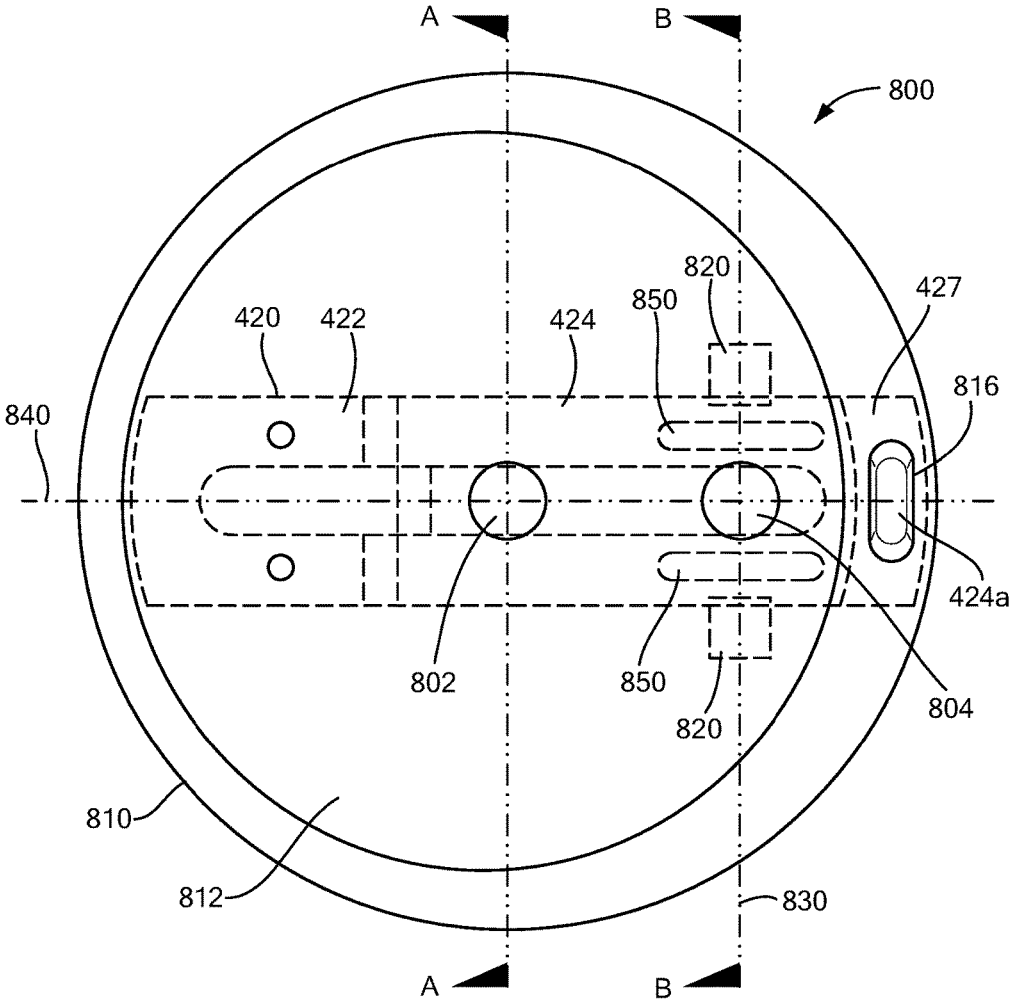
FIG. 8*a* is a top view of a second embodiment of a container lid in accordance with the present invention employing a first button to temporarily unseal a drinking aperture and a second button operative to permanently open a valve so that the drinking aperture remains unsealed.
Figure 8B:
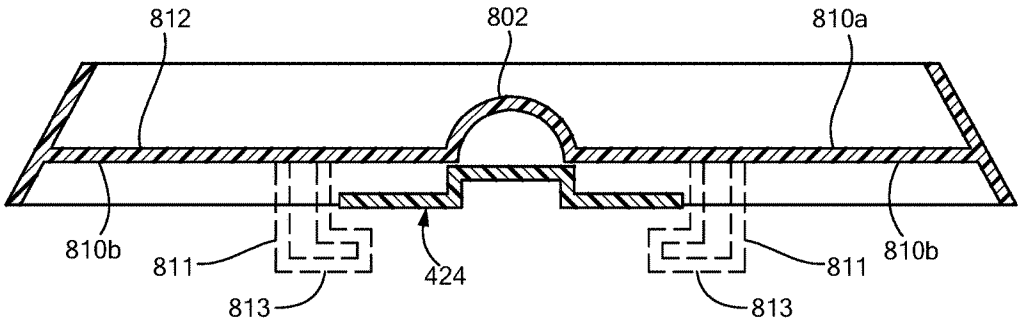
FIG. 8*b* is a cross-sectional view along section AA of FIG. 8*a* illustrating a first button and valve positioned to seal the drinking aperture.
Figure 8C:
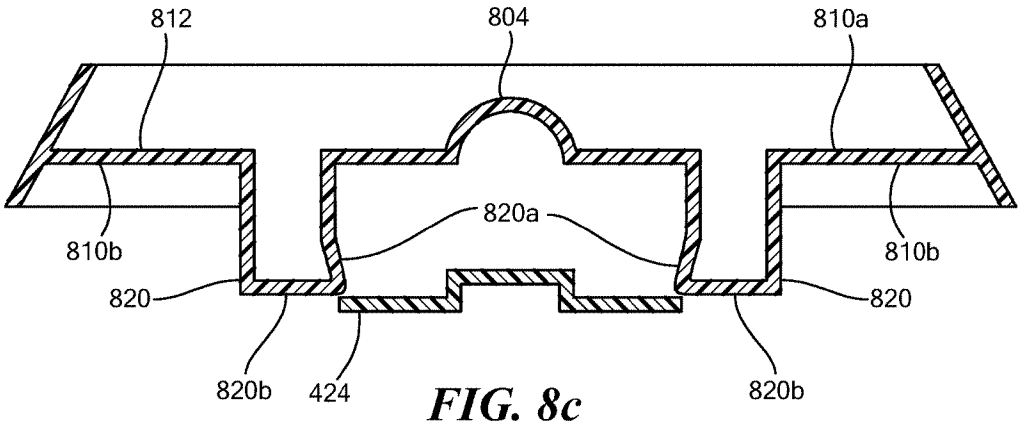
FIG. 8*c* is a cross-sectional view along section BB of FIG. 8*a* illustrating the configuration of the lid and valve after the second button has been depressed to urge the second portion of the valve beyond the distal ends of locking posts.

Referring to FIGS. 8*a*-8*c*, a second embodiment of a container lid 800 in accordance with the present invention is illustrated. The container lid 800 includes a body member

810 and a valve 420, as previously discussed, and may be formed of the same materials as discussed with respect to the first embodiment discussed above. The body member 810 includes a central portion 812 and an outer periphery including a drinking aperture 816. The central portion 812 has a top surface 810*a* and a bottom surface 810*b*. The valve 420, as previously described, is permanently affixed to the bottom surface 810*b* of the central portion 812 of the body member 810. The central portion 812 includes a first actuator 802 on the central portion 812 which is used to temporarily unseal the drinking aperture 816 upon the application of pressure to the first actuator 802. The second portion 424 of the valve is formed so that the sealing member 427 is lightly sprung toward the drinking aperture 816. Thus, upon removal of applied pressure to the first actuator 802, the sealing member 427 reseals the drinking aperture 816.

Referring to FIG. 8*b*, one or more stops 811 may optionally be provided to limit the deflection of the second portion 424 of the valve 420. In the illustrated embodiment opposing stops 811 are shown. The stops 811 include a projection, a ledge or flange 813 that serves to limit the downward travel of the second portion 424 of the valve 420 so as to prevent inadvertent locking of the valve 420 in the unsealed orientation in response to depression of the first actuator 802.

A second actuator 804 is provided that, in the illustrated embodiment, extends outward from the top surface 810*a* of the central portion 812. As noted with respect to the first embodiment, the actuators may comprise buttons, recesses or generally flat regions of the top surface of the central portion 812. The second actuator in the illustrated embodiment is positioned adjacent a second contact region of the second portion 424 of the valve 420. The second contact region may be the top surface of the rib 428 of the second portion 424 or a contact region formed in the second portion and configured so as to be downwardly deflected in response to the application of pressure to the second actuator 804. Opposed posts 820 extend downward from the bottom surface 810*b* of the central portion 812 and are located on opposing sides of the second button 804 along a transverse axis 830 that is perpendicular to a longitudinal axis 840 of the valve 420. The posts 820 have inner walls 820*a* and distal ends 820*b* spaced from the bottom surface 810*b* of the central portion 812. The inner walls 820*a* are angled inwardly along at least a portion of the posts 820 so that the spacing between opposed inner walls 820*a* is greater adjacent the bottom surface 810*b* of the central portion than at the distal ends 820*b* of the posts 820. More specifically, the inner walls 820*a* of opposed posts 820 are spaced by a first distance d1 that is greater than a width w of the second portion 424 along the transverse axis 830 and adjacent the bottom surface 810*b* and are spaced by a distance d2 which is less than the width w of the second portion 424 of the valve 420 along the transverse axis at the distal ends 820*b* of the posts 820.

Upon the application of sufficient manual pressure to the second actuator 804, the bottom surface 810*b* of the central portion 812 adjacent the second actuator 804 is cooperative with the second contact region of the second portion 424 and deflects the second portion 424 beyond the inwardly angled walls 820*a* of the posts 820. Pushing the second actuator 804 with sufficient force causes the second portion 424 to flex in the transverse direction to permit the second portion 424 to move beyond the section of the opposed posts 820 having a narrowed spacing therebetween. Once the second portion 424 of the valve 420 is deflected beyond the portion of the inwardly angled walls 820*a* having the narrowed spacing therebetween, the second portion 424 cannot return to its original position since the spacing between the opposed inner walls 820*a* is less than the width of the second portion 424 of the valve 420 along the transverse axis 830. Consequently, the above-described mechanism secures or locks the valve 420 such that the drinking aperture 816 remains permanently unsealed.

Longitudinal slots 850 may optionally be provided in the second portion 424 of the valve 420 to increase the transverse flexibility of the second portion 424 to reduce the force needed to urge the second portion 424 of the valve 420 beyond the distal ends 820*b* of the posts 820.

Although in the above-described embodiments, the illustrated actuators used for sealing and unsealing the aperture are illustrated as buttons, the actuators may alternatively be flat actuator regions within the central portion, or depressions or recesses in the central portion which would appear as generally inverted buttons. Application of manual pressure to flat actuator regions or to depressions within the top surface would provide the same operation of the valve 420 as hereinabove described.

In further embodiments, the posts may be disposed along a transverse axis that extends through the posts and the actuator or, alternatively, the actuator may be spaced from the transverse axis. Additionally, while the valve is shown having a width that is generally constant it will be recognized that the width may vary in different sections of the first and second portions with the relevant width being that along the transverse axis that extends through the posts.

While the illustrated embodiment includes a pair of opposed spaced posts, a single post may alternatively be employed to provide the locking function in the second embodiment as discussed above.

Figure 4:
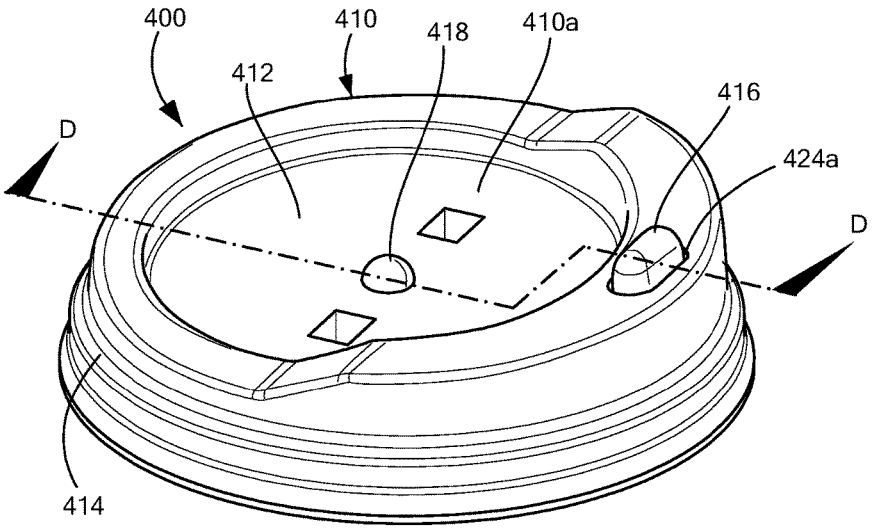
FIG. 4 is a perspective view of a first embodiment of a container lid in accordance with the present invention illustrating the top surface of the lid.
Figure 5:
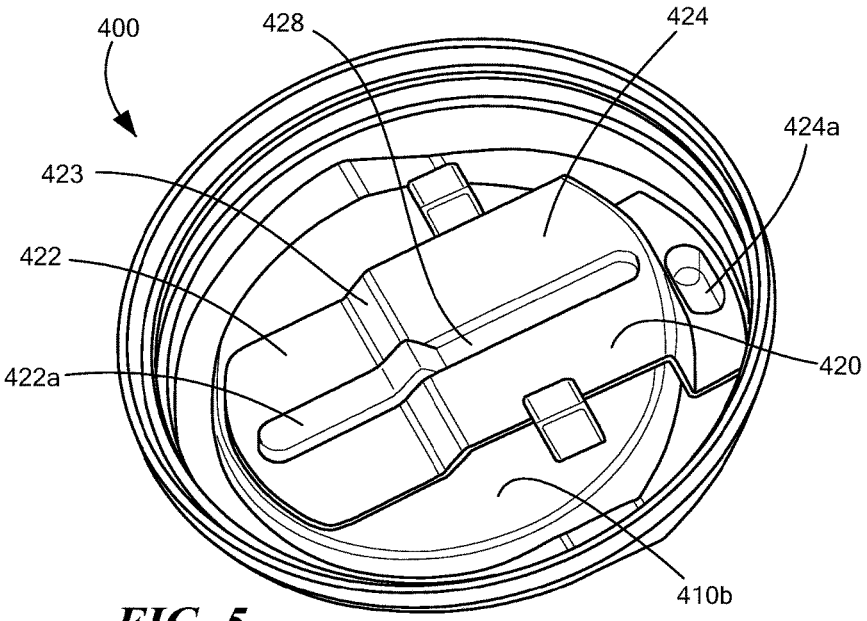
FIG. 5 is a perspective view of the container lid of FIG. 4 illustrating a valve mounted to the bottom surface of the container lid.
Figure 6:
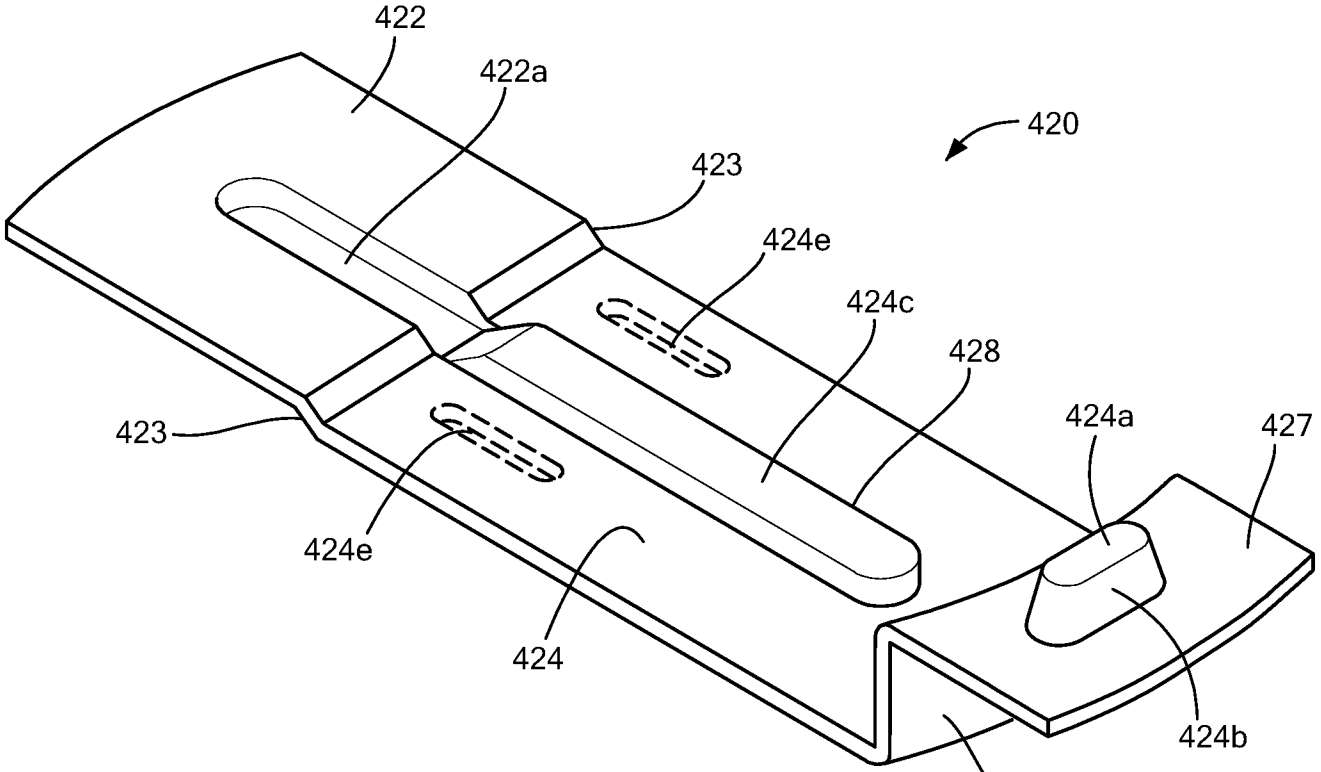
FIG. 6 is a perspective view of the valve employed in the container lid of FIG. 5.
Figure 9A:
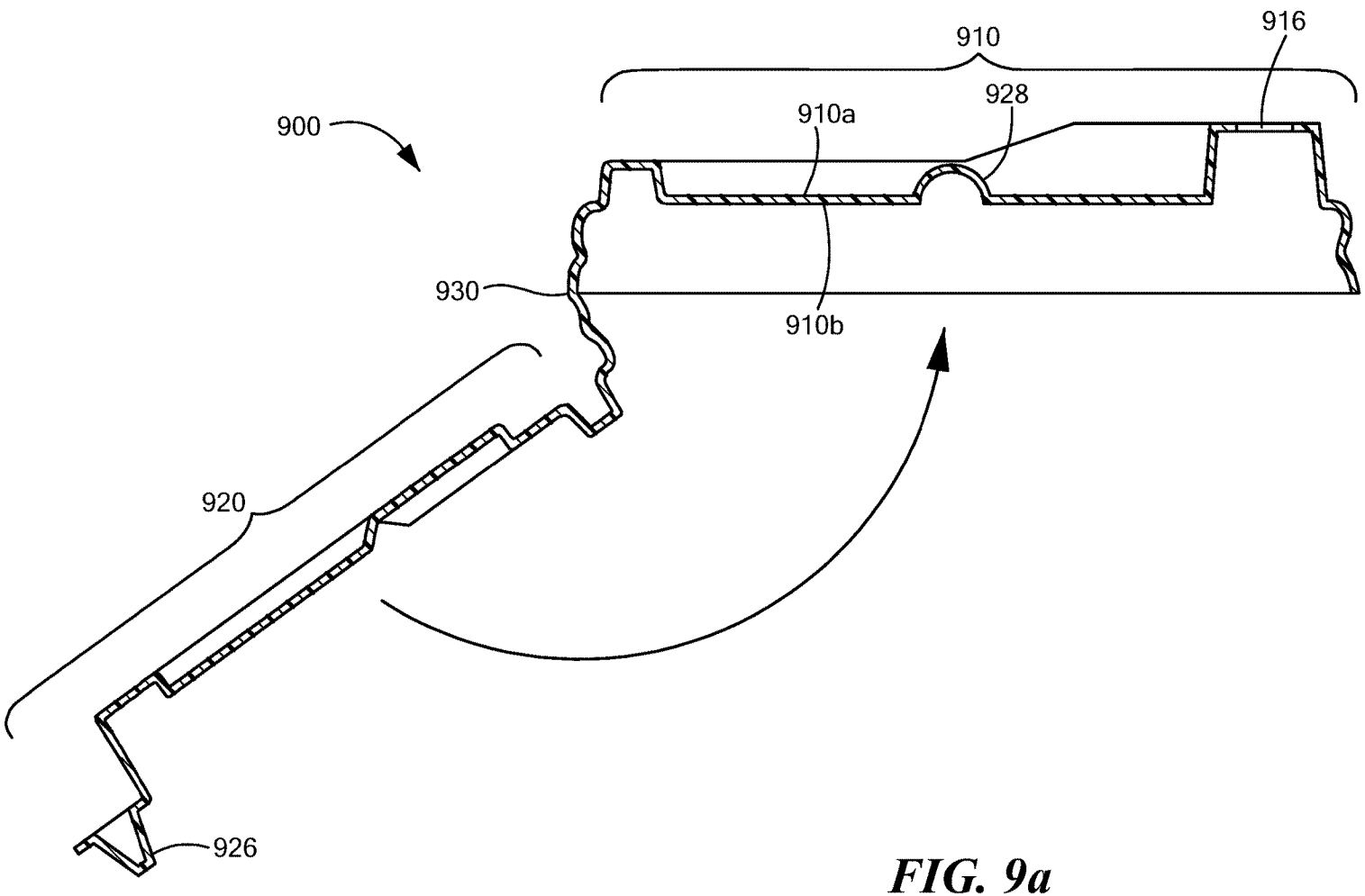
FIG. 9*a* is a cross-sectional view of a container lid in accordance with the present invention that includes an interconnection portion coupling a body member to a valve as a unitary, one-piece continuous structure.
Figure 9B:
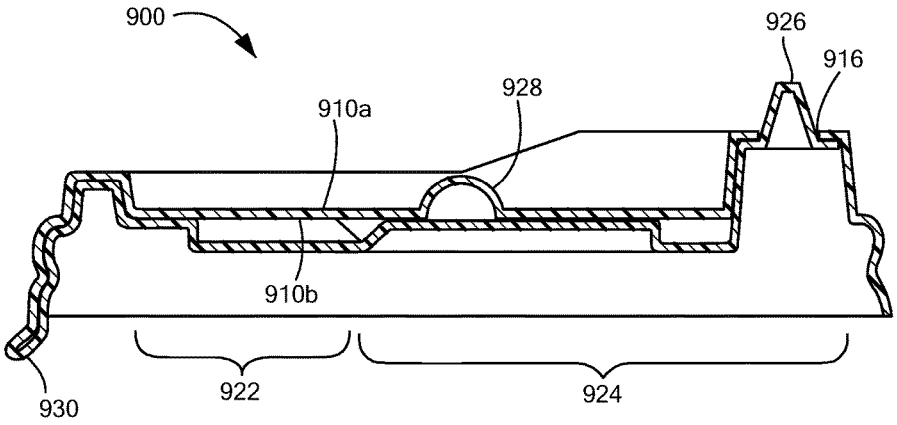
FIG. 9*b* is a cross-sectional view of the container lid of FIG. 9*a* illustrating the interconnection portion folded and formed to position the valve adjacent the bottom surface of the body member as oriented upon the mounting of the lid to a fluid container with the sealing member in the sealed orientation.
Figure 9C:
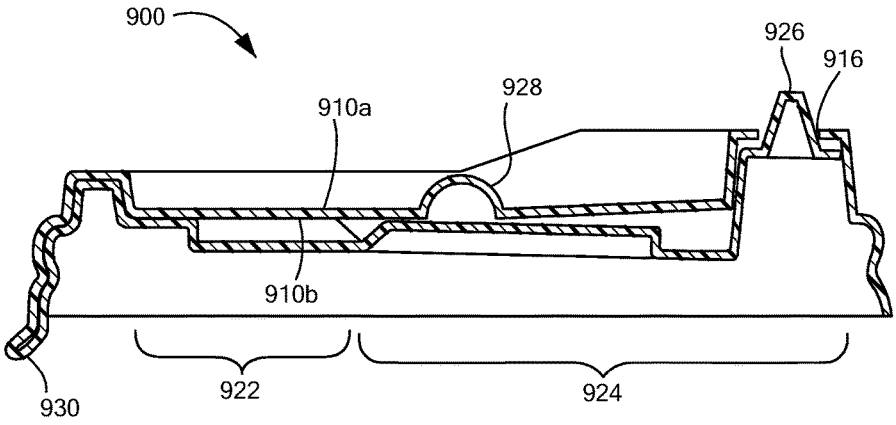
FIG. 9*c* is a cross-sectional view of the container lid of FIG. 9*a* illustrating the valve in an unsealed orientation following deflection of the valve in response to an applied force to an actuator region of the body member.

FIGS. 9*a*-9*c* illustrate cross-section DD of the lid of FIG. 4 of an embodiment of a container lid 900 in accordance with the present invention that includes an interconnection portion 930 that extends between and couples a body member 910 and a valve 920. The configuration of the body member 910 corresponds to the body member 410 discussed above and the configuration of the valve 920 corresponds to the configuration of the valve 420 discussed above. The body member 910, interconnection portion 930 and the valve 920 are formed of a thin resilient material as a unitary, single piece, continuous structure such as by vacuum forming, molding, or any other suitable process from the materials previously discussed. As illustrated, the body member 910 includes a top surface 910*a*, a bottom surface 910*b*, a drinking aperture 916 and an actuator region 928, which, in the illustrated embodiment is a button. Other actuator structures may be employed as previously discussed. The valve 920 includes a first portion 922 and a second portion 924 which correspond in structure and function to the first portion 422 and the second portion 424 previously described. As illustrated, the second portion 924 includes a sealing member including a protuberance 926 for sealing the drinking aperture 916. The lid 900 also includes a locking mechanism employing one or more posts as discussed hereinabove but not shown in the cross-sections of FIGS. 9*a*-9*c*. The interconnection portion 930 and the valve 920 are configured such that the first portion 922 of the valve 920 generally confronts and/or abuts the bottom surface 910*b* of the body member 910 when the interconnection portion 910 is folded and formed so that the valve 920 is disposed below the bottom surface 910*b* of the body member 910. In one embodiment, when circumferential lip of the lid 900 is urged over the lip of a fluid container to secure the lid to the container, the interconnection portion 930 assumes the orientation illustrated in FIGS. 9*b* and 9*c* and causes the valve 920 to assume the sealing orientation depicted in FIG. 6. The illustrated interconnection portion 930 may be employed in embodiments having either a single actuator region 928, as shown, or two actuator regions such as illustrated in FIGS. 8*a*-8*c* and discussed above.

In any of the above-described embodiments the first portion of the valve may be secured to the bottom surface of the body member via welding, for example, ultrasonic welding, heat sealing, staking, or use of any adhesive as previously noted. Additionally, one or more protrusions or bosses may be formed in either the first portion or the body member. The protrusions or bosses may be disposed in and engage walls of one or more corresponding recesses provided in the opposing body member or first portion, respectively, to mechanically affix and secure the first portion of the valve to the body member.

In the embodiment illustrated in FIGS. 9*a*-9*c*, the first portion 922 of the valve 920 need not be secured to the bottom surface 910*b* of the body member 910, but instead, may be folded and formed so as to confront the bottom surface 910*b* as illustrated upon mounting of the lid 900 to a fluid container (not shown). Upon such mounting, the rim of the fluid container urges the interconnection portion 930 against the inner peripheral edge of the body member 910 and maintains proper orientation of the valve 920 with respect to the bottom surface 910*b* of the body member 910 so that the valve 920 functions as described hereinabove to seal and unseal the drinking aperture.

It will further be appreciated by those of ordinary skill in the art that the desired configuration and function of the valve in terms of required orientation and deflection in response to a force applied to an actuator regions may be achieved by appropriate thinning and thickening of selected regions of the body member, valve and/or interconnection portion.

It will be appreciated that modifications to and variations of the above-described container lid may be made without departing from the inventive concepts described herein. Accordingly, the invention is not to be viewed a limited except by the scope and spirit of the appended claims.

What is claimed is:

1. A lid for mounting to a fluid container comprising:

a body member formed as a continuous member of a resilient material, the body member having a top surface and a bottom surface, the body member including a drinking aperture adjacent a peripheral edge, the body member including an actuator region on the top surface of the body member; and a valve formed as a continuous member of a resilient material, the valve including a first valve portion and a second valve portion that extends from the first valve portion to a second valve portion distal end, the first valve portion being secured to the bottom surface of the body member, the second valve portion distal end including a sealing member, wherein:

the valve is configured as a spring-like member so as to urge the sealing member in sealing engagement with the drinking aperture to generally seal the drinking aperture in a sealing orientation in the absence of the application of downward manual force to the actuator region of the body member;

the valve and the body member are configured and cooperative, in response to the application of a first downward manual force to the actuator region, to deform the body member and deflect the second portion of the valve to cause the sealing member to be spaced from the drinking aperture and below the bottom surface of the body member so as to unseal the drinking aperture and permit fluid flow therethrough and, in response to removal of the first downward manual force from the actuator region, to reassume the sealing orientation; and the valve and the body member are configured and cooperative, in response to the application to the actuator region of a second downward manual force that is greater than the first downward manual force, to assume an unsealed orientation in which the sealing member is spaced from the drinking aperture and below the bottom surface of the body member to permit fluid flow through the drinking aperture and in which, in response to removal of the second downward manual force from the actuator region, to remain in the unsealed orientation.

2. The lid of claim 1 wherein the actuator is one of:

a button extending from the top surface of the body member, a recess in the top surface of the body member, and a designated region of a central portion of the body member.

3. The lid of claim 1 wherein the first valve portion is secured to the bottom surface of the body member by at least one of:

welding;

heat sealing, staking;

mechanical engagement of a boss extending from one of the first valve portion and the body member with walls of a cooperative recess in the other one of the first valve portion and the body member; and an adhesive.

4. The lid of claim 1 wherein the second valve portion has a length and a longitudinal axis along the length of the second valve portion, and the second valve portion includes at least one rib parallel to the longitudinal axis to provide stiffness to the second valve portion along the longitudinal axis.

5. The lid of claim 1 wherein the second valve portion has a length and a longitudinal axis, and the second valve portion includes at least one opening through the second valve portion to provide greater flexibility in a direction transverse to the longitudinal axis.

6. The lid of claim 1 wherein the sealing member comprises a protuberance cooperative with the drinking aperture to substantially seal the drinking aperture when disposed therein when the second valve portion is disposed in the sealing orientation.

7. The lid of claim 1 wherein the body member and the valve are a thin and resilient deformable material, each being selected from the group of a plastic, a bio-degradable material and a metal.

8. The lid of claim 1 wherein the body member and the valve are polystyrene.

9. The lid of claim 1 further including an interconnection portion extending between the peripheral edge of the body member and the first portion of the valve, wherein the body member, the interconnection portion and the valve are a unitary, one-piece, continuous member.

10. A lid for mounting to a fluid container comprising:

a body member formed as a continuous member of a resilient material, the body member having a top surface and a bottom surface, the body member including a drinking aperture adjacent a peripheral edge, the body member including an actuator region on the top surface of the body member; and a valve formed as a continuous member of a resilient material, the valve including a first valve portion and a second valve portion that extends from the first valve portion to a second valve portion distal end, the first valve portion being secured to the bottom surface of the body member, the second valve portion distal end including a sealing member, wherein:

the valve is configured as a spring-like member so as to urge the sealing member in sealing engagement with the drinking aperture to generally seal the drinking aperture in a sealing orientation in the absence of the application of downward manual force to the actuator region of the body member;

the valve and the body member are configured and cooperative, in response to the application of a first downward manual force to the actuator region, to deform the body member and deflect the second portion of the valve to cause the sealing member to be spaced from the aperture so as to unseal the drinking aperture and permit fluid flow therethrough and, in response to removal of the first downward manual force from the actuator region, to reassume the sealing orientation; and the valve and the body member are configured and cooperative, in response to the application to the actuator region of a second downward manual force that is greater than the first downward manual force, to assume an unsealed orientation in which the sealing member is spaced from the drinking aperture to permit fluid flow therethrough and in which, in response to removal of the second downward manual force from the actuator region, to remain in the unsealed orientation, wherein the body member includes at least one post extending from the bottom surface of the body member, the second portion of the valve being cooperative with the at least one post to maintain the valve in the unsealed orientation in response to the application and removal of the second downward manual force.

11. The lid of claim 10 wherein:

the at least one post extending from the bottom surface of the body member includes a pair of opposed spaced posts extending from the bottom surface of the body member, the pair of opposed spaced posts having inner opposing surfaces and distal ends, wherein a first distance between the inner opposing surfaces adjacent the bottom surface of the body member is greater than a second distance between the inner opposing surfaces adjacent the distal ends;

the second valve portion having a width perpendicular to a longitudinal axis extending through the first valve portion and the second valve portion, wherein the width is less than the first distance and greater than the second distance; and in response to the application of the second downward manual force to the actuator region, a portion of the bottom surface of the body member abuts a contact region of the second valve portion and deflects the second valve portion adjacent the pair of opposed spaced posts beyond the distal ends of the pair of opposed spaced posts so as to maintain the valve in the unsealed orientation with the sealing member spaced from the drinking aperture.

12. The lid of claim 10 further including an interconnection portion extending between the peripheral edge of the body member and the first valve portion, wherein the body member, the interconnection portion and the valve are a unitary, one-piece, continuous member.

13. A lid for mounting to a fluid container comprising:

a body member formed as a continuous member of a resilient material, the body member having a top surface and a bottom surface, the body member including a drinking aperture adjacent a peripheral edge, the body member including a first actuator region on the top surface of the body member and a second actuator region on the top surface of the body member; and a valve formed as a continuous member of a resilient material, the valve including a first valve portion and a second valve portion that extends from the first value portion to a second valve portion distal end, the first valve portion being secured to the bottom surface of the body member, the second valve portion distal end including a sealing member, wherein:

the valve is configured as a spring-like member so as to urge the sealing member in sealing engagement with the drinking aperture in a sealing orientation in the absence of the application of a downward manual force to both the first actuator region of the body member and the second actuator region of the body member;

the valve and the body member are configured and cooperative, in response to the application of a first downward manual force to the first actuator region, to deform the body member and deflect the second valve portion to cause the sealing member to be spaced from the drinking aperture in an unsealed orientation so as to permit fluid flow through the drinking aperture and, in response to removal of the first downward manual force from the first actuator region, to reassume the sealing orientation; and the valve and the body member are configured and cooperative, in response to the application of a second downward manual force to the second actuator region, to assume the unsealed orientation in which the sealing member is spaced from the drinking aperture to permit fluid flow through the drinking aperture and in which, in response to removal of the second downward manual force from the second actuator region, to remain in the unsealed orientation.

14. The lid of claim 13 wherein the first actuator region and the second actuator region are each selected from the group of:

a button extending from the top surface of the body member, a recess in the top surface of the body member, and a designated region of a central portion of the body member.

15. The lid of claim 13 wherein the first valve portion is secured to the bottom surface of the body member by at least one of:

welding;

heat sealing, staking;

mechanical engagement of a boss extending from one of the first valve portion and the body member with walls of a cooperative recess in the other one of the first valve portion and the body member; and an adhesive.

16. The lid of claim 13 wherein the second valve portion has a length and a longitudinal axis and the second valve portion includes at least one rib parallel to the longitudinal axis to provide stiffness to the second valve portion along the longitudinal axis.

17. The lid of claim 13 wherein the second valve portion has a length and a longitudinal axis and the second valve portion includes at least one opening through the second portion to provide greater flexibility in a direction transverse to the longitudinal axis.

18. The lid of claim 13 wherein the sealing member comprises a protuberance cooperative with the drinking aperture to substantially seal the drinking aperture when disposed therein in the sealing orientation.

19. The lid of claim 13 wherein the body member and the valve are a thin and resilient deformable material, each being selected from the group of a plastic, a bio-degradable material and a metal.

20. The lid of claim 13 wherein the body member and the valve are polystyrene.

21. The lid of claim 13 further including an interconnection portion extending between a peripheral edge of the body member and the first portion of the valve, wherein the body member, the interconnection portion and the valve are a unitary, one-piece, continuous member.

22. A lid for mounting to a fluid container comprising:

a body member formed as a, continuous member of a resilient material, the body member having a top surface and a bottom surface, the body member including a drinking aperture adjacent a peripheral edge, the body member including a first actuator region on the top surface of the body member and a second actuator region on the top surface of the body member; and a valve formed as a, continuous member of a resilient material, the valve including a first valve portion and a second valve portion that extends from the first valve portion to a second valve portion distal end, the first valve portion being secured to the bottom surface of the body member, the second valve portion distal end including a sealing member, wherein:

the valve is configured as a spring-like member so as to urge the sealing member in sealing engagement with the drinking aperture in a sealing orientation in the absence of the application of a downward manual force to both the first actuator region of the body member and the second actuator region of the body member;

the valve and the body member are configured and cooperative, in response to the application of a first downward manual force to the first actuator region, to deform the body member and deflect the second portion of the valve to cause the sealing member to be spaced from the drinking aperture in an unsealed orientation so as to permit fluid flow through the drinking aperture and, in response to removal of the first downward manual force from the first actuator region, to reassume the sealing orientation;

the valve and the body member are configured and cooperative, in response to the application of a second downward manual force to the second actuator region, to assume the unsealed orientation in which the sealing member is spaced from the drinking aperture to permit fluid flow through the drinking aperture and in which, in response to removal of the second downward manual force from the second actuator region, to remain in the unsealed orientation, wherein the body member includes at least one post extending from the bottom surface of the body member and the second valve portion is cooperative with the at least one post to maintain the valve in the unsealed orientation in response to the application and removal of the second downward manual force to the second actuator region.

23. The lid of claim 22 wherein:

the at least one post extending from the bottom surface of the body member includes a pair of opposed spaced posts extending from the bottom surface of the body member, the pair of opposed spaced posts having inner opposing surfaces and distal ends, wherein a first distance between the inner opposing surfaces adjacent the bottom surface of the body member is greater than a second distance between the inner opposing surfaces adjacent the distal ends;

the second portion of the valve having a width perpendicular to a longitudinal axis extending through the first valve portion and the second valve portion, wherein the width is less than the first distance and greater than the second distance; and in response to the application of the second downward manual force to the second actuator region, a portion of the bottom surface of the body member adjacent the second actuator region abuts a contact region of the second valve portion and deflects the second valve portion adjacent the pair of opposed spaced posts beyond the distal ends of the pair of opposed spaced posts so as to maintain the second portion in the unsealed orientation with the sealing member spaced from the drinking aperture.

24. The lid of claim 22 further including an interconnection portion extending between the peripheral edge of the body member and the first valve portion, wherein the body member, the interconnection portion and the valve are a unitary, one-piece, continuous member.

* * * * *